US011154893B1

(12) United States Patent
Matern

(10) Patent No.: US 11,154,893 B1
(45) Date of Patent: Oct. 26, 2021

(54) FENCE PAINTING SYSTEM

(71) Applicant: Matt Matern, Duncanville, TX (US)

(72) Inventor: Matt Matern, Duncanville, TX (US)

( * ) Notice: Subject to any disclaimer, the term of this patent is extended or adjusted under 35 U.S.C. 154(b) by 0 days.

(21) Appl. No.: 16/006,058

(22) Filed: Jun. 12, 2018

Related U.S. Application Data

(60) Provisional application No. 62/518,354, filed on Jun. 12, 2017.

(51) Int. Cl.

| | |
|---|---|
| ***B05B 13/02*** | (2006.01) |
| ***B05B 7/04*** | (2006.01) |
| ***B05B 13/04*** | (2006.01) |
| ***E04H 17/00*** | (2006.01) |
| ***B05C 5/02*** | (2006.01) |

(52) U.S. Cl.
CPC ..... *B05B 13/0214* (2013.01); *B05B 7/0416* (2013.01); *B05B 13/041* (2013.01); *B05B 13/0436* (2013.01); *B05C 5/02* (2013.01); *B05C 5/0295* (2013.01); *E04H 17/00* (2013.01)

(58) Field of Classification Search
None
See application file for complete search history.

(56) References Cited

U.S. PATENT DOCUMENTS 2,489,445 A * 11/1949 Benzuly ..... B05B 13/0207 118/305
4,353,324 A * 10/1982 Schnittker ..... B05C 9/04 118/207
4,999,676 A * 3/1991 Mouri ..... G03G 15/0896 118/689
6,631,818 B1 * 10/2003 Ito ..... B66C 13/23 118/423

* cited by examiner

*Primary Examiner* — Jethro M. Pence
(74) *Attorney, Agent, or Firm* — Leavitt Eldredge Law Firm

(57) ABSTRACT

A fence painting system enables applying a coating to a both the front and back of the fence simultaneously. The system uses spray modules mounted to an anchor to apply the coating. The anchor attaches to the top of the fence and lowers the spray models with an extension device. The modules detect the ground as they descend with a sensor that prevents the modules from impacting the ground.

3 Claims, 8 Drawing Sheets

FENCE PAINTING SYSTEM

BACKGROUND

1. Field of the Invention

The present invention relates generally to painting systems, and more specifically, to a fence painting system for applying a coating to the surfaces of a wall or barrier.

2. Description of Related Art

Painting systems are well known in the art and are effective means to apply paint or other fluid coatings to various objects. For example, FIG. 1 depicts a conventional compressed air gun system 101 having a nozzle 103 through which a mixture of compressed air from a reservoir 105 and paint are sprayed on a fence 107. During use, the nozzle 103 is moved over the surface of the fence 107 to apply a coating of the paint on the fence 107.

One of the problems commonly associated with system 101 is limited efficiency. For example, the nozzle 103 must be moved manually over the surface of the fence 107 which is time consuming.

Accordingly, although great strides have been made in the area of compressed air gun systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
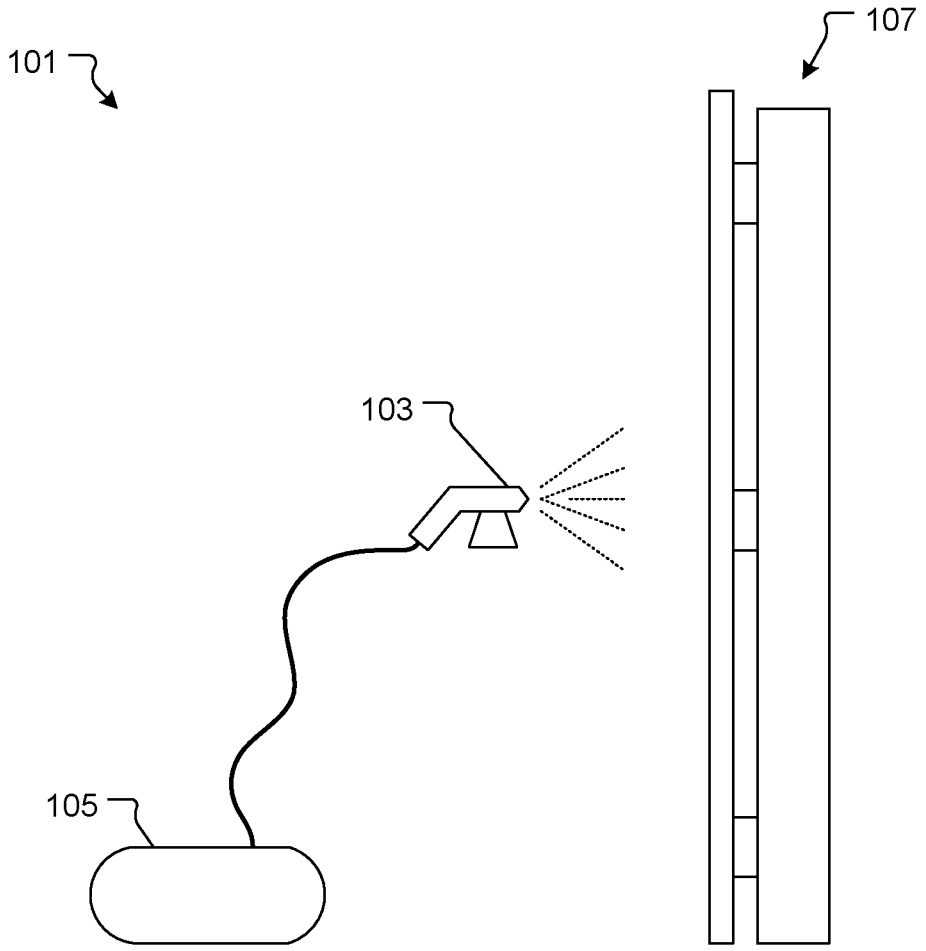
FIG. 1 (Prior Art)
FIG. 1 is a side view of a common compressed air gun system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional compressed air gun systems. Specifically, the invention of the present application enables the rapid application of a coating to a fence. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
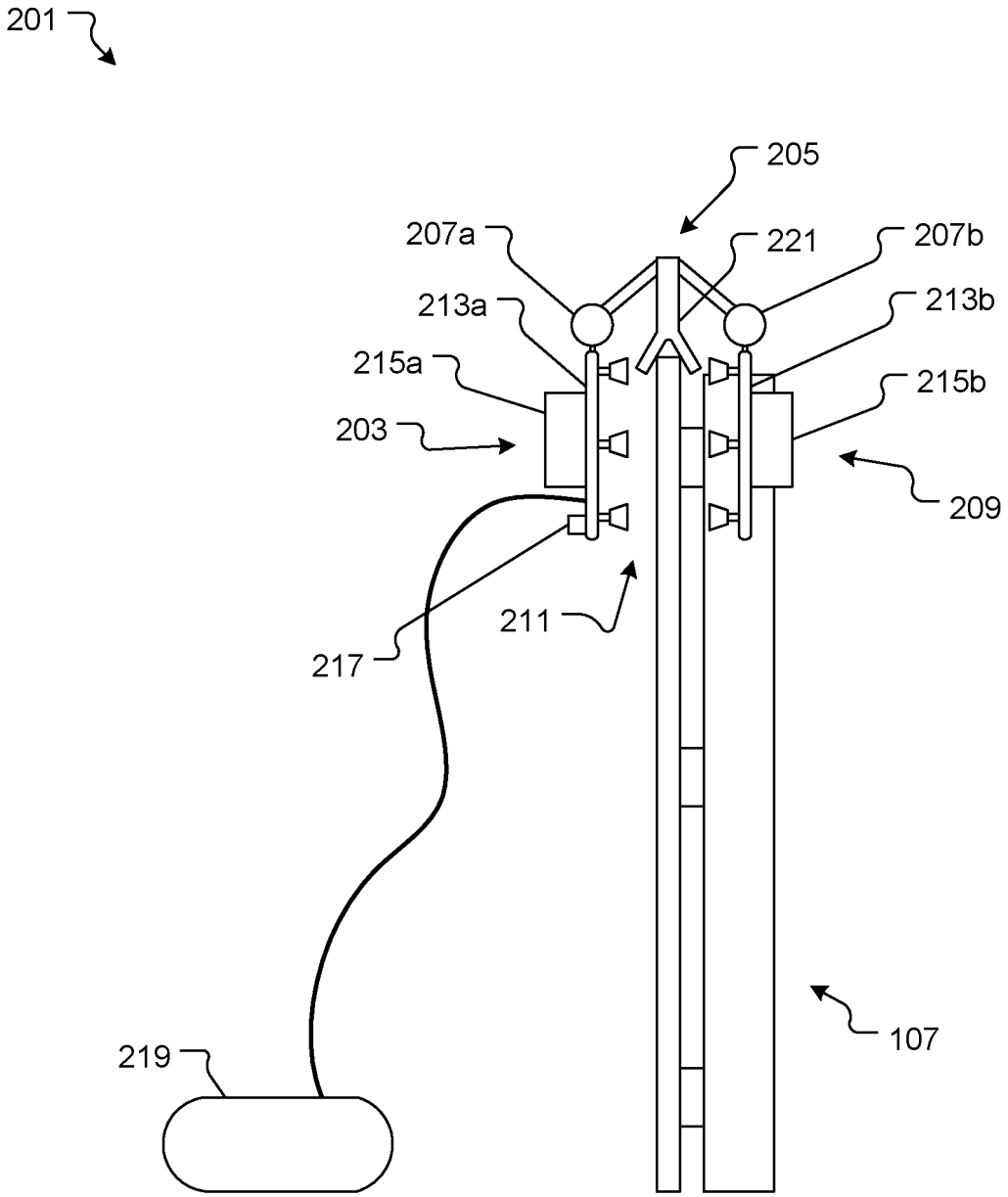
FIG. 2 is a side view of a fence painting system in accordance with a preferred embodiment of the present application.

Referring now to the drawings wherein like reference characters identify corresponding or similar elements throughout the several views, FIG. 2 depicts a side view of a fence painting system in accordance with a preferred embodiment of the present application. It will be appreciated that system 201 overcomes one or more of the above-listed problems commonly associated with conventional compressed air gun systems.

In the contemplated embodiment, system 201 includes a first spray module 203 attached to an anchor 205 via and extension device 207. A second spray module 209 attached to the anchor 205 via an extension device 207. The first spray module 203 and second spray module configured to apply a coating to the front and back sides of a fence 107 simultaneously.

The spray modules 203, 209 each having nozzles 211 attached to a framework 213. The framework 213 having a coating container 215 rigidly attached and in fluid communication with the nozzles 211. The framework 213 also having a sensor 217 rigidly attached near the bottom and configured to detect the proximity of objects such as the ground. The spay modules 203, 209 in fluid communication with an air source 219.

The anchor 205 having an attachment device 221 to rigidly attach the anchor 205 to the top of the fence 107. The anchor 205 is configured to allow the first spray module 203 and second spray module to pass over the surfaces of the fence 107 and apply a coating. The anchor 205 could be a clamp, weight or the like.

Figure 3C:
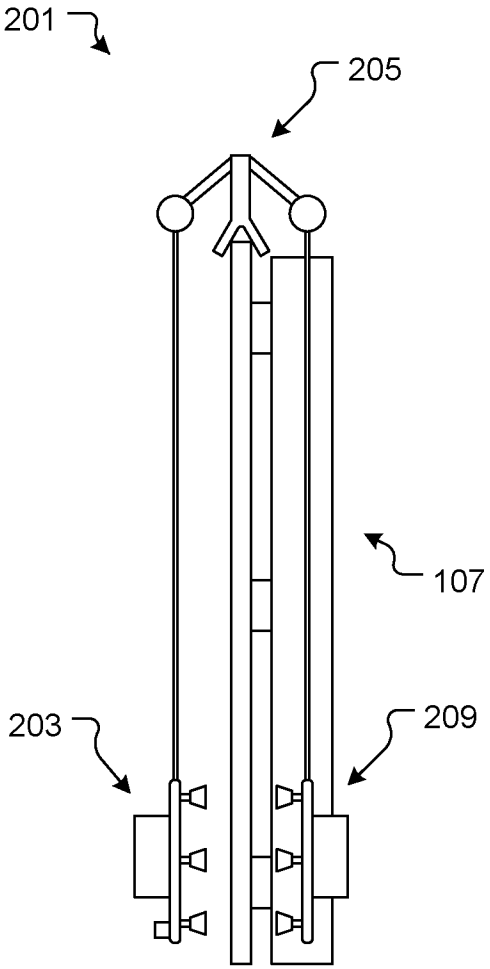
FIGS. 3A, 3B and 3C are side views of the system of FIG. 2 in use.
Figure 3B:
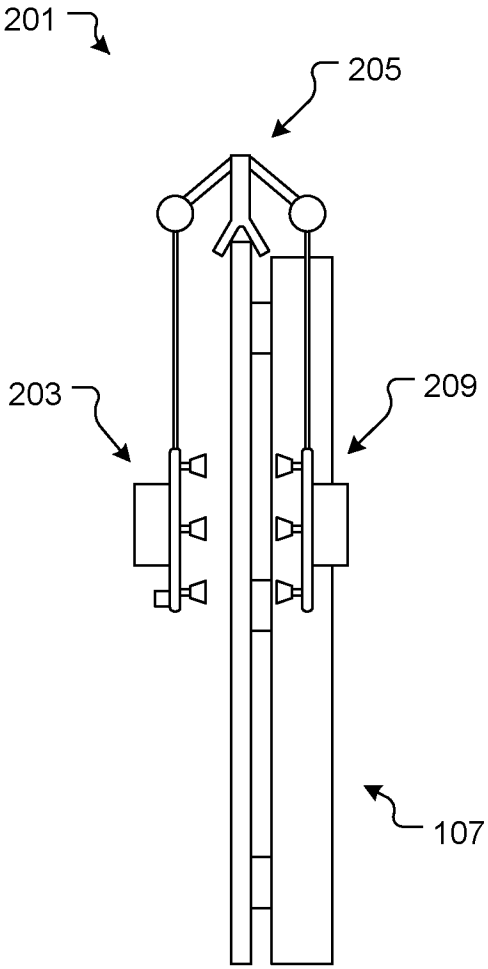
Figure 3A:
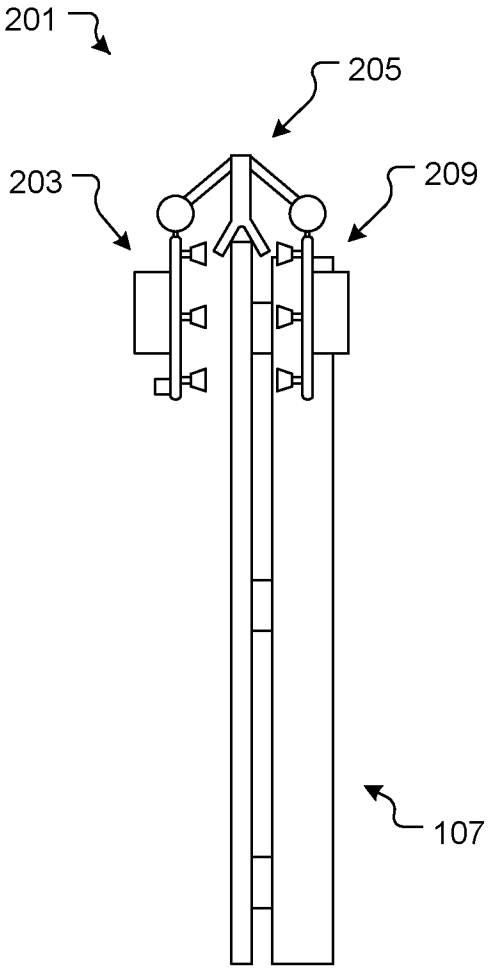

In use, anchor 205 is attached to the top of the fence 107 so that a spray module is on either side of the fence 107. The spray modules 203, 209 are lowered by the extension device 207 on either side of the fence as depicted in FIGS. 3A, 3B and 3C. The coating material in the containers 215 is forced through the nozzles 211 by the air source 219. The sensor 217 detects the ground and stops the extension device 207 which then pull the spray modules 203, 209 back up. The sensor 217 while depicted as a proximity detector could be any device that prevents the system from colliding with ground, e.g. predetermined height to descend.

It should be appreciated that one of the unique features believed characteristic of the present application is that spray modules 203, 209 and extension device 207 enable the rapid painting of both sides of a fence 107.

Figure 4:
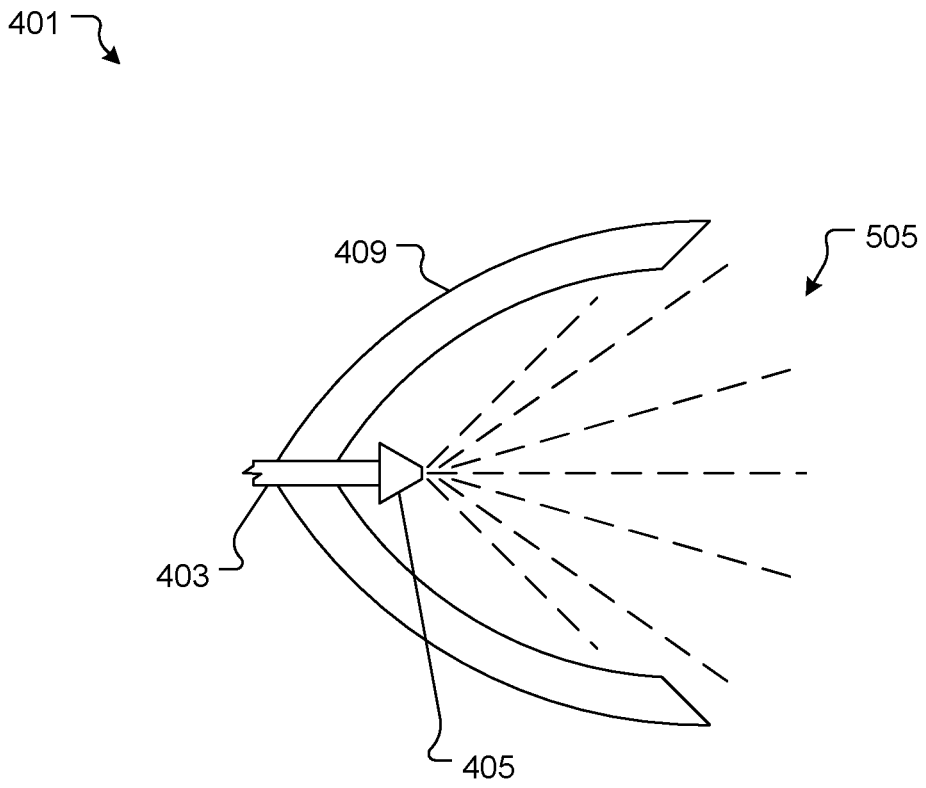
FIG. 4 is a side view of an alternative embodiment of the nozzle of FIG. 2.

Referring now to FIG. 4 an alternative embodiment of the nozzles 211 is depicted. Embodiment 401 including a tube 403 removably attached to a tip 405. The tube 403 allows the mixture 407 of air and coating to pass through to the tip 405 where it exits and is applied to the target surface. The tube having a shield 409 rigidly attached to ensure that the mixture 407 only reaches the target surface.

While nozzles 211, 401 have been depicted any method of applying a coating to the fence is contemplated such as rollers, brushes or the like.

Figure 5:
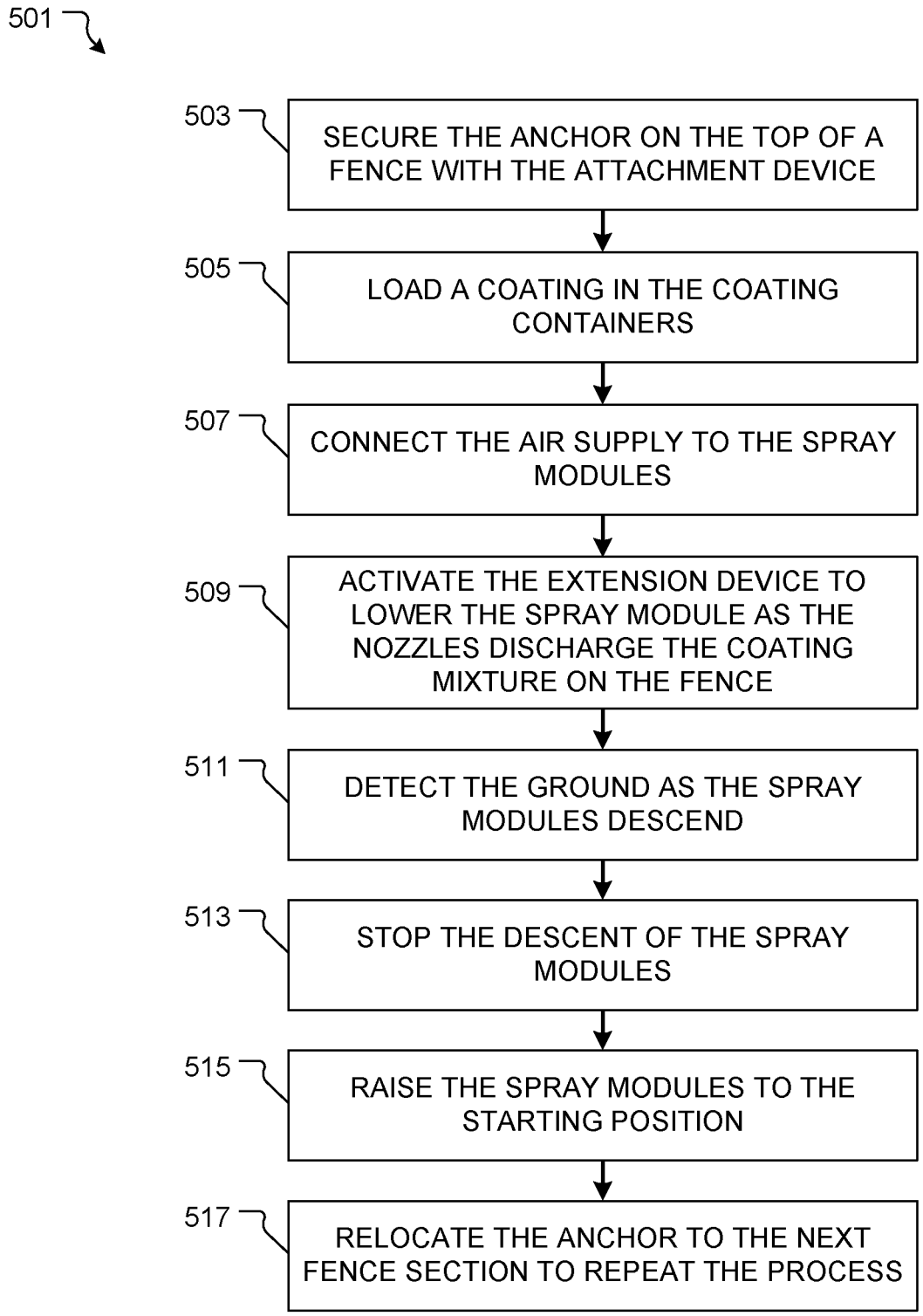
FIG. 5 is a flowchart of the preferred method of use of the system of FIG. 2.

The preferred method of use of the system of FIG. 2 is depicted in FIG. 5. Method 501 including, securing the anchor on the top of a fence with the attachment device 503, loading a coating in the coating containers 505, connecting the air supply to the spray modules 507, activating the extension device to lower the spray modules as the nozzles discharge the coating mixture on the fence 509, detecting the ground as the spray modules descend 511, stopping the descent of the spray modules 513, raising the spray modules to the starting position 515 and relocating the anchor to the next fence section to repeat the process 517.

Figure 6:
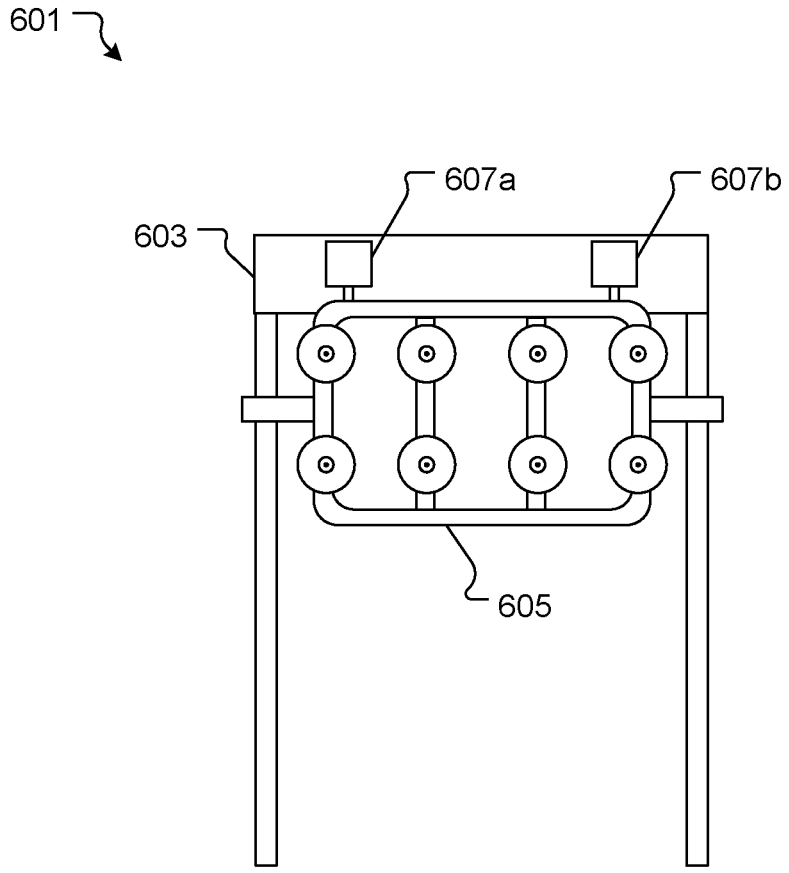
FIG. 6 is a front view of an alternative embodiment of the system of FIG. 2.

Referring now to FIG. 6 an alternative embodiment of the system of FIG. 2 is depicted. Embodiment 601 including a support frame 603 in movably attached to a spray module 605. The support frame 603 having an extension device 607 rigidly attached and configured to allow the spray module 605 to traverse the support frame 603 in a vertical manner. The support frame 603 enables the system 601 to be free standing as the spray module 605 discharges a coating. It will be appreciated that system 601 enables interior walls to be coated. It will also be appreciated that any surface without a top suitable for an anchor to be attached could be coated in this manner.

Figure 7:
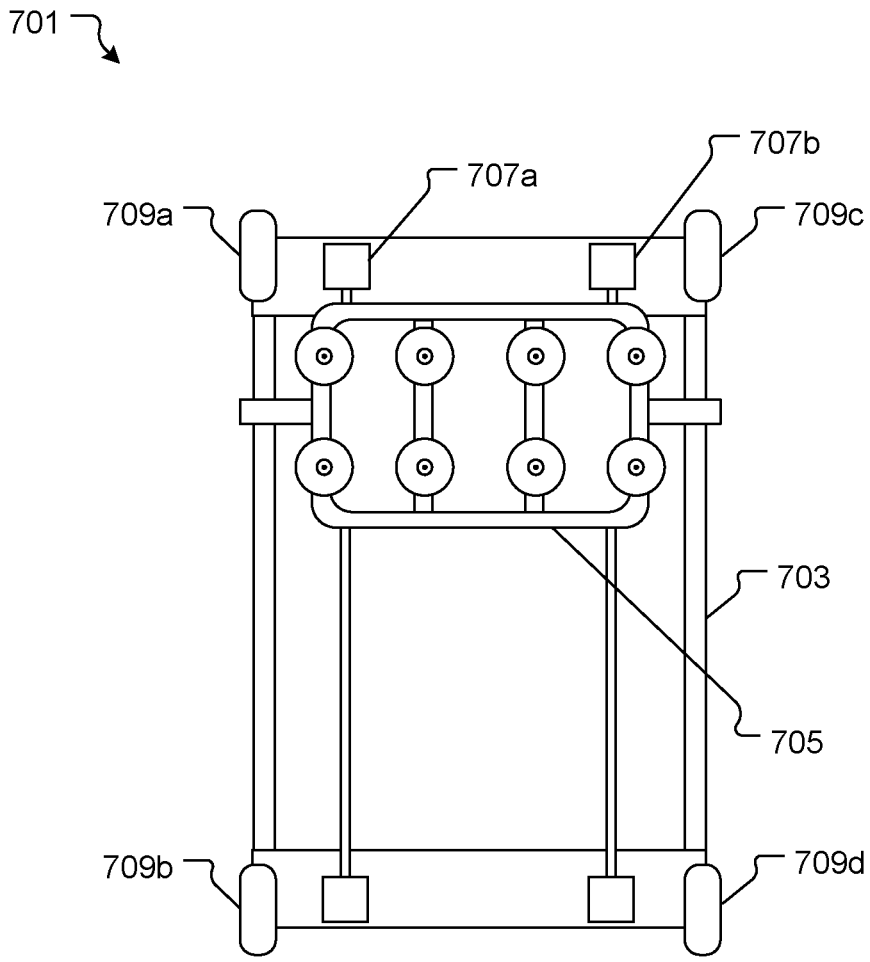
FIG. 7 is a bottom view of an alternative embodiment of the system of FIG. 2.

Referring now to FIG. 7 an alternative embodiment of the system of FIG. 2 is depicted. Embodiment 701 including support frame 703 in movably attached to a spray module 705. The support frame 703 having braces 709 attached to hold the spray module 705 off the target surface. The support frame 703 having a movement device 707 rigidly attached and configured to allow the spray module 705 to traverse the support frame 703 in a horizontal manner. The support frame 703 enables the system 701 to be free standing in a horizontal position as the spray module 705 discharges a coating. It will be appreciated the horizontal surfaces such as floors and planning could be coated in this manner.

Figure 8:
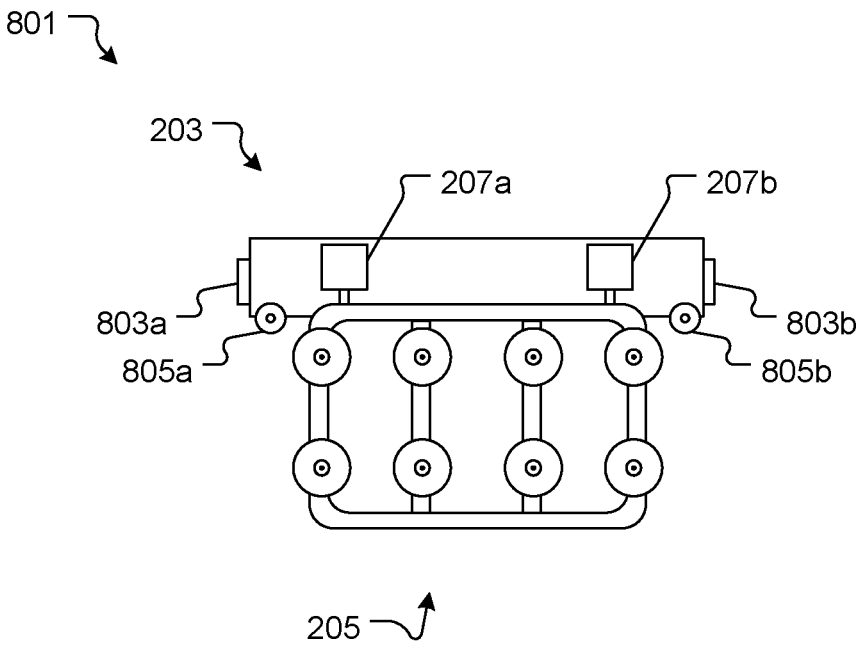
FIG. 8 is a front view of an alternative embodiment of the system of FIG. 2.

Referring now to FIG. 8 an alternative embodiment of the system of FIG. 2 is depicted. Embodiment 801 includes the features of system 201 with the addition of the anchor 203 having wheels 805 attached to that the anchor 203 rests on the fence via the wheels 805. The anchor 203 also having sensors 803 attached. The sensors 803 configured to detect the presence of the coating. In use, once the coating has been applied where the system is located the wheels 805 move the system 801 along the top of the fence until it reaches the next section to be painted as detected by the sensors 803.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A fence painting system for a fence having a front surface and a back surface comprising:

an anchor that attaches to a top of the fence via an attachment device;

a first spray module attached to the anchor via a first extension device; and a second spray module attached to the anchor via a second extension device;

the first spray module including:

a first plurality of nozzles attached to a framework;

the framework having coating container in fluid communication with the first plurality of nozzles and a sensor to determine a position of the first spray module with respect to a ground surface; and the first plurality of nozzles are in fluid communication with an air supply; and the second spray module having a second plurality of nozzles;

wherein the first plurality of nozzles is configured to apply paint to the front surface of the fence while simultaneously the second plurality of nozzles is configured to apply paint to the back surface of the fence; and wherein both the first extension device and the second extension device are configured to both lower and raise the first spray module and the second spray module as they apply the paint to the fence via the first plurality of nozzles and the second plurality of nozzles.

2. The system of claim 1, wherein the nozzles have shields rigidly attached to a tube, configured to control an application area of the nozzles.

3. The system of claim 1, wherein the anchor includes a plurality of wheels whereupon the system rests on the fence and the anchor also includes sensors to determine a presence or lack of the coating.

* * * * *